US012144391B2

(12) United States Patent
Bartholet et al.

(10) Patent No.: US 12,144,391 B2
(45) Date of Patent: Nov. 19, 2024

(54) WALKING DEVICE

(71) Applicant: Masai International Pte Ltd., Singapore (SG)

(72) Inventors: Markus Bartholet, Appenzell (CH); Claudio Franco, Montebelluna (IT)

(73) Assignee: Masai International PTE LTD, Singapore (SG)

( * ) Notice: Subject to any disclaimer, the term of this patent is extended or adjusted under 35 U.S.C. 154(b) by 222 days.

(21) Appl. No.: 17/305,286

(22) Filed: Jul. 2, 2021

(65) Prior Publication Data

US 2021/0361026 A1 Nov. 25, 2021

Related U.S. Application Data

(63) Continuation of application No. 12/922,613, filed as application No. PCT/EP2008/011053 on Dec. 22, 2008, now abandoned.

(30) Foreign Application Priority Data

Mar. 29, 2008 (EP) ..... 08006209

(51) Int. Cl.
*A43B 13/12* (2006.01)
*A43B 7/14* (2022.01)
(Continued)

(52) U.S. Cl.
CPC ..... *A43B 13/12* (2013.01); *A43B 7/144* (2013.01); *A43B 7/24* (2013.01); *A43B 13/026* (2013.01);
(Continued)

(58) Field of Classification Search
None
See application file for complete search history.

(56) References Cited

U.S. PATENT DOCUMENTS 3,561,141 A 2/1971 Brown
4,241,523 A 12/1980 Daswick
(Continued)

FOREIGN PATENT DOCUMENTS

EP 1869989 A1 12/2007
ES 283249 Y 5/1985
(Continued)

OTHER PUBLICATIONS

International Search Report for International Patent Application No. PCT/EP2008/011053, mailed on Mar. 23, 2009 (w/ English translation).
(Continued)

*Primary Examiner* — Jila M Mohandesi
(74) *Attorney, Agent, or Firm* — Armstrong Teasdale LLP

(57) ABSTRACT

The walking device has a shoe bottom (10) with a midsole (16). A soft heel part (20) is arranged in a recess (18) of the midsole (16) and the outsole (22) has a form that is rounded convexly in the walking direction. The reinforcing element (12), forming an insole, is arranged on the upper surface (44) of the midsole (16) and fastened to it. In the production of the walking device, the upper (14) is joined to the reinforcing element (12) to form a structural unit, which is then mounted on the midsole (16), for example by adhesive bonding.

20 Claims, 3 Drawing Sheets

(51) Int. Cl.

| | |
|---|---|
| ***A43B 7/144*** | (2022.01) |
| ***A43B 7/24*** | (2006.01) |
| ***A43B 13/02*** | (2022.01) |
| ***A43B 13/14*** | (2006.01) |
| ***A43B 13/18*** | (2006.01) |
| ***A43B 21/26*** | (2006.01) |

(52) U.S. Cl.
CPC ..... *A43B 13/145* (2013.01); *A43B 13/187* (2013.01); *A43B 21/26* (2013.01)

(56) References Cited

U.S. PATENT DOCUMENTS

| | | | | |
|---|---|---|---|---|
| 4,372,059 | A | 2/1983 | Ambrose | |
| 5,174,049 | A | 12/1992 | Flemming | |
| 5,285,583 | A | 2/1994 | Aleven | |
| 5,579,591 | A | 12/1996 | Kousaka et al. | |
| 5,761,834 | A | 6/1998 | Grim et al. | |
| 6,038,790 | A | 3/2000 | Pyle et al. | |
| 6,341,432 | B1 * | 1/2002 | Muller | A43B 13/12 36/102 |
| 6,519,874 | B1 | 2/2003 | Dean | |
| 6,782,639 | B1 * | 8/2004 | Muller | A43B 13/145 36/117.4 |
| 7,461,470 | B2 * | 12/2008 | Dardinski | A43B 7/1464 36/97 |
| 7,513,065 | B2 * | 4/2009 | Kita | A43C 15/168 36/27 |
| 7,814,683 | B2 * | 10/2010 | Lee | A43B 21/30 36/28 |
| 8,893,406 | B2 * | 11/2014 | Auger | A43B 13/40 36/102 |
| 2005/0039350 | A1 | 2/2005 | Hung | |
| 2007/0163150 | A1 | 7/2007 | Yang | |
| 2007/0294915 | A1 * | 12/2007 | Ryu | A43B 13/183 36/28 |
| 2008/0289215 | A1 | 11/2008 | Park | |

FOREIGN PATENT DOCUMENTS

| | | | | |
|---|---|---|---|---|
| GB | 2110520 | A | 6/1983 | |
| GB | 2288720 | A * | 11/1995 | A43B 13/181 |
| GB | 2200030 | A | 7/1998 | |
| JP | 2008018167 | A | 1/2008 | |
| KR | 100807365 | B1 | 3/2008 | |
| WO | 1999005928 | A1 | 2/1999 | |
| WO | WO-9905928 | A1 * | 2/1999 | A43B 1/0072 |
| WO | 2001015560 | A1 | 3/2001 | |
| WO | 2006065047 | A1 | 6/2006 | |
| WO | 2009010933 | A2 | 1/2009 | |

OTHER PUBLICATIONS

International Preliminary Report on Patentability for International Patent Application No. PCT/EP2008/011053, mailed on Oct. 5, 2010 (w/ English translation).

Notice of Acceptance in Australian Application No. 2008353894, mailed Oct. 17, 2013, 3 pages.

Judgment, *Masai International Pte Ltd.* v. *D'Torres Calzado Ortopedico, S.L.*, case No. 1075/15, of the Mercantile Court No. 2 of the city of Valencia, Nov. 3, 2017, and partial translation thereof; 90 pages.

* cited by examiner

WALKING DEVICE

CROSS-REFERENCE TO RELATED APPLICATIONS

This application is a continuation of U.S. patent application Ser. No. 12/922,613, filed on Dec. 7, 2010, which is a national stage entry of International Patent Application No. PCT/EP2008/011053, filed Dec. 22, 2008, which claims the benefit of foreign priority of European Patent Application No. 08006209.4, filed Mar. 29, 2008.

The present invention relates to a walking device according to the preamble of patent claim 1.

Walking devices of this type are known by the name Masai Barefoot Technology, MBT for short, and also known under the Swiss Masai label. A characteristic feature of the MBT walking devices is a form of sole that is rounded convexly in the walking direction, with a soft heel part, known as the "Masai sensor", inserted in a recess of a midsole. The midsole has a reinforcing element—known as a "shank"—integrated in it, which reinforces the midsole in such a way that it is substantially rigid even in the portion thereof that is above the soft heel part. Through the thereby deliberately soft and destabilizing made structure of the MBT walking device, the foot looses its hold and support that is characteristic of physiological locomotion. This bottom structure acts on major parts of the postural and supporting musculature, because the body must now be actively kept in balance. On account of these constantly required minimal compensating movements and tensings of the musculature of the foot in seeking to maintain a stable standing position, wearing MBT shoes is like permanently performing sensorimotor training and works additional parts of the musculature of the skeleton. In particular, neglected muscles are trained, posture and gait pattern are improved and the body is toned and shaped. Furthermore, wearing MBT shoes can alleviate back, hip, leg or foot ailments and joint, muscle, ligament or tendon injuries to as well as relieve hip and knee joints. The known bottoms of the MBT shoes have a considerable thickness.

Footwear of a similar kind is also known from WO 2006/065047 A1.

Furthermore, WO 99/05928 discloses a shoe which is suitable in particular for skateboarding, the upper of which is joined by means of Strobel seams to a woven or nonwoven insole. The insole, preferably produced from a stable nonwoven, has forefoot slits and star-shaped heel cuts, to improve the bending properties of the insole. In a heel cutout of the midsole, a shock absorbing cassette is arranged.

It is an object of the present invention to provide a walking device of the generic type with a shoe bottom of smaller thickness that still has the known properties of the walking device of the generic type.

This object is achieved by a walking device which has the features of patent claim 1.

According to the invention, the reinforcing element is no longer integrated in the midsole but is produced as a separate component and then fastened to the midsole, for example by adhesive bonding. In the case of the walking device according to invention, the reinforcing element consequently forms an insole.

In the case of the known walking devices of the generic type, the reinforcing element has in the heel region and in the midfoot region a thickness of about 6 mm and the reinforcing element is covered on top and underneath by the material of the midsole. The upper covering of the midsole, on which a thin top sole may optionally be arranged, forms the foot bed. By contrast with this, the walking device according to the invention does not have any covering in the form of material of the midsole above the reinforcing element, and preferably the reinforcing element, on which a thin top sole may optionally be arranged, forms the foot bed. Moreover, the reinforcing element can be made thinner, in particular in certain regions. This has the overall effect of providing a walking device with a shoe bottom of a smaller height.

In a preferred way, the upper of the walking device is fastened to the reinforcing element. This makes it possible to produce the upper together with the reinforcing element as one structural unit, which is then joined to the shoe bottom.

In this joining it is possible just to fasten the reinforcing element directly to the midsole, but it is advantageous for the upper also to be directly fastened to the midsole at the same time.

Particularly simple production of the walking device according to the invention is achieved by the reinforcing element covering the upper surface of the midsole at least almost completely.

By forming at least one reinforcing rib on the reinforcing element, the latter can be formed with very thin walls in the other regions, without losing its intrinsic stability and rigidity as a result.

Further preferred embodiments of the walking device according to the invention are defined in the further dependent patent claims.

The invention is explained in more detail on the basis of an exemplary embodiment that is represented in the purely schematic drawing, in which.

Figure 10:
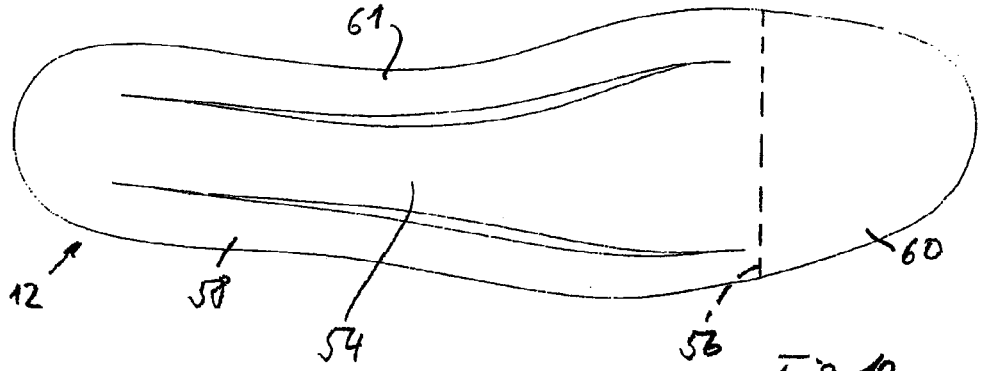
FIG. 10 shows a reinforcing element for a walking device according to the invention in a view from below.
Figure 11:
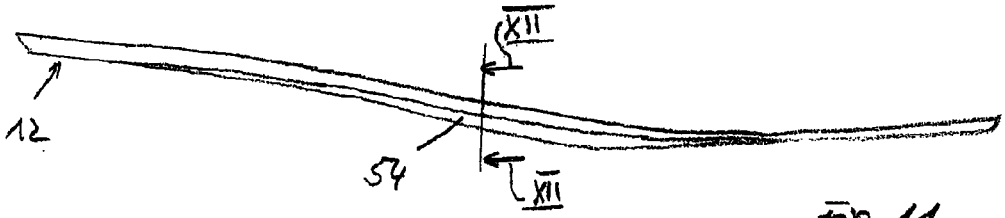
FIG. 11 shows the reinforcing element of FIG. 10 in elevation.
Figure 12:
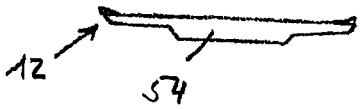
FIG. 12 shows the reinforcing element in cross section along the line XII-XII of FIG. 11.
Figure 13:
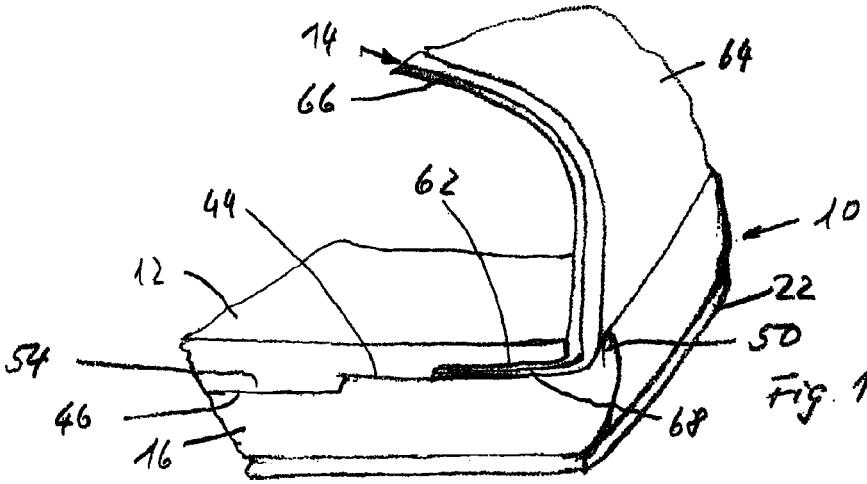
FIG. 13 shows part of a walking device according to the invention in a perspective representation and in section, with a shoe bottom according to FIGS. 1 to 9 and a reinforcing element according to FIGS. 10 to 12.

The embodiment of a walking device according to the invention that is represented in the drawing has a shoe bottom 10, represented in FIGS. 1 to 9, a reinforcing element 12, according to FIGS. 10 to 12, and a generally known upper 14, as indicated in FIG. 13. The reinforcing element 12 forms an insole, to which the upper 14 is attached in a known manner—by means of lasting. Said upper 14, together with the reinforcing element 12, are fastened to the shoe bottom 10, for example by adhesive bonding.

The shoe bottom 10 has a midsole 16, a soft heel part 20, arranged in a recess 18 of the midsole 16, and an outsole 22. The outsole 22 has—in the unloaded state—a form that is continuously rounded convexly in the walking direction L from the rear end 24 of the shoe bottom 10 to the front end 26 of the shoe bottom 10, in the walking direction L. It is kept in this form by the midsole 16 and the soft heel part 20. This form is typical of shoe bottoms 10 of MBT shoes (MBT is a registered trademark of Masai Marketing and Trading AG, Romanshorn) and is also disclosed, for example, in WO 01/15560.

The outsole 22 is preferably produced from an abrasion-resistant rubber-elastic material. Its modulus of elasticity in the region of the heel is, for example, between approximately 3.4 and 4.1 N/mm$^2$, preferably approximately 3.75 N/mm$^2$, and in the region of the ball is, for example, between approximately 3.8 and 4.5 N/mm$^2$, preferably between approximately 4.0 and 4.3 N/mm$^2$; measured with a punch 20 mm in diameter and a loading of 500 N. However, the outsole 22 may also have approximately the same modulus of elasticity over its entire length. Its Shore A hardness is, for example, approximately 50 to 75, preferably approximately 60 to 70.

The convex form of the outsole 22 has in a heel region 30 lying at the rear, seen in the longitudinal direction L of the shoe, a radius of curvature of approximately 160 mm. In a midfoot region 32, adjoining the heel region 30 in the walking direction L, the curvature of the outsole 22 is less and has a radius of curvature of approximately 280 mm. In a ball and toe region 34, arranged at the front, in the walking direction L, and adjoining the midfoot region 32, the radius of curvature up to at least almost the front end 26 of the shoe bottom 10 is somewhat greater than in the midfoot region 32 and is approximately 390 mm. The data specified above and thicknesses specified further below concern a walking device of European size 37. It may change according to the size of the walking device, although the ratio of the stated radii of curvature of about 1:1.75:2.44 is preferably approximately maintained. In a preferred way, the curvature of the outsole 22 has in the heel region 30 a radius of approximately 150 mm to 200 mm, in the midfoot region 32 a radius of approximately 250 mm to 350 mm and in the ball and toe region 34 a radius of approximately 350 mm to 480 mm. The heel region 30, midfoot region 32 and ball and toe region 34 each extend approximately over one third of the length of the shoe bottom 10. The midsole 16 extends uninterruptedly over these regions.

The soft heel part 20 has in elevation, as illustrated in particular by FIGS. 1, 3, 5 and 6, a substantially convex-convex-lenticular cross section, which extends from the inner side 42 to the outer side 40 of the shoe bottom 10 with at least almost constant cross section in the direction transverse to the walking direction L. It is preferably produced from an open-cell polyurethane elastomer foam and of a soft form with respect to the other parts of the shoe bottom 10. Its density is, for example, between approximately 0.24 and approximately 0.3, preferably approximately 0.27 mg/mm$^3$. The modulus of elasticity is, for example, between approximately 0.4 and 0.5, preferably approximately 0.46 N/mm$^2$, measured with a pressure punch 20 mm in diameter and a loading of 100 N. The (Shore A) hardness of the soft heel part 20 is preferably approximately 20. The soft heel part 20 may also be of a form that is softer or harder, for example its Shore A hardness is between 15 and 25.

Figure 1:
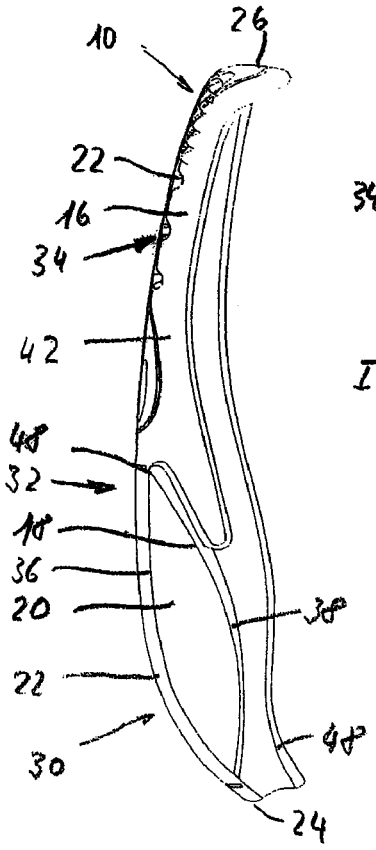
FIG. 1 shows the inner side of a shoe bottom of a walking device according to the invention, in a view in the direction of the arrow I of FIG. 2.
Figure 2:
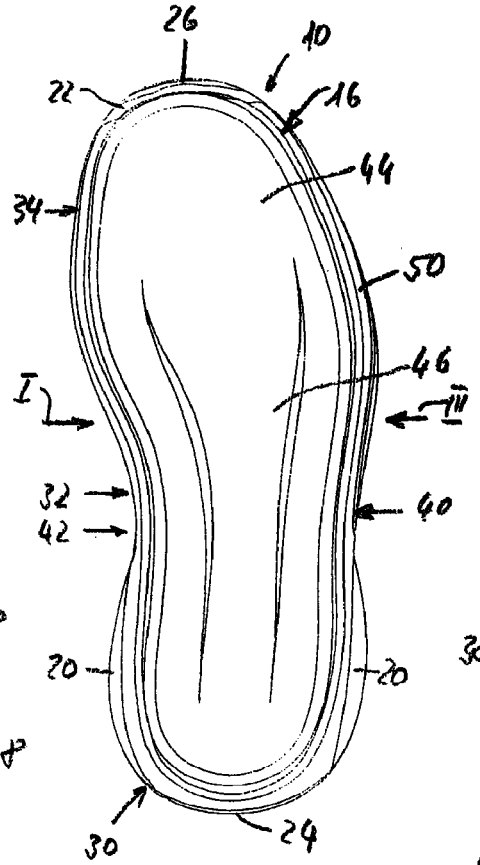
FIG. 2 shows the shoe bottom from FIG. 1 in a plan view.
Figure 3:
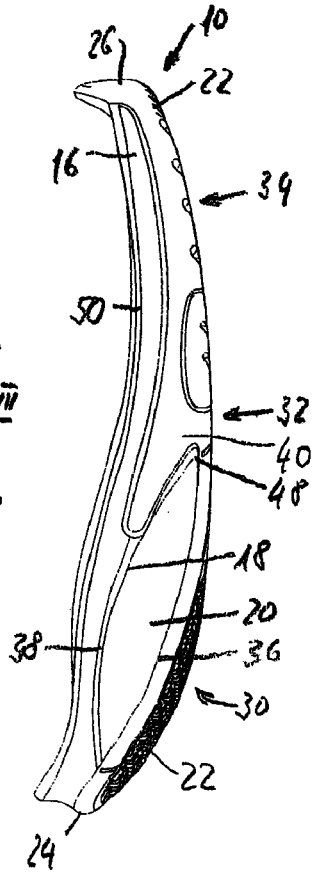
FIG. 3 shows the outer side of the shoe bottom of FIGS. 1 and 2 in a view in the direction of the arrow III of FIG. 2.
Figure 4:
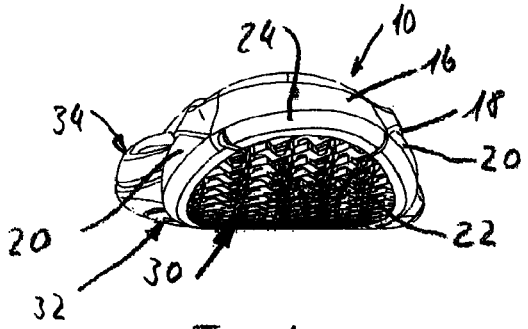
FIG. 4 shows the shoe bottom of FIGS. 1 to 3 in a side view seen toward the heel.
Figure 5:
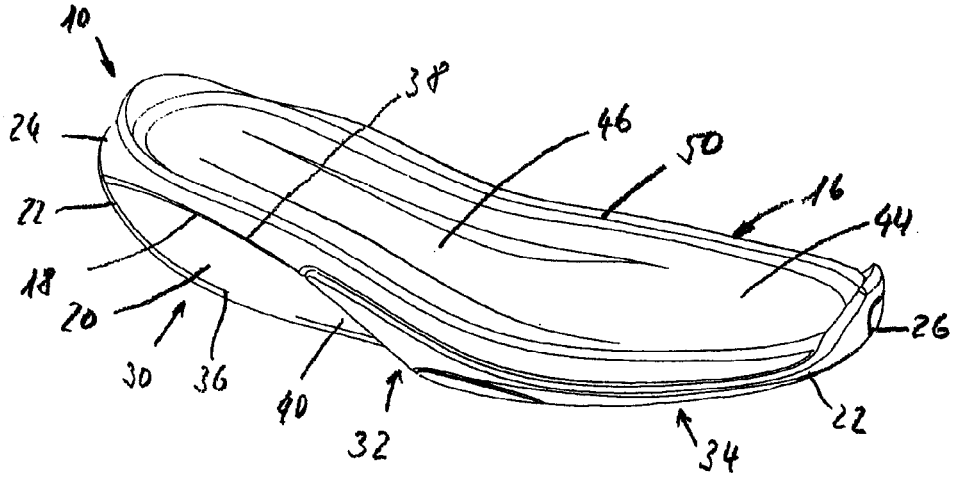
FIG. 5 shows the shoe bottom of FIGS. 1 to 4 in a perspective representation.
Figure 6:
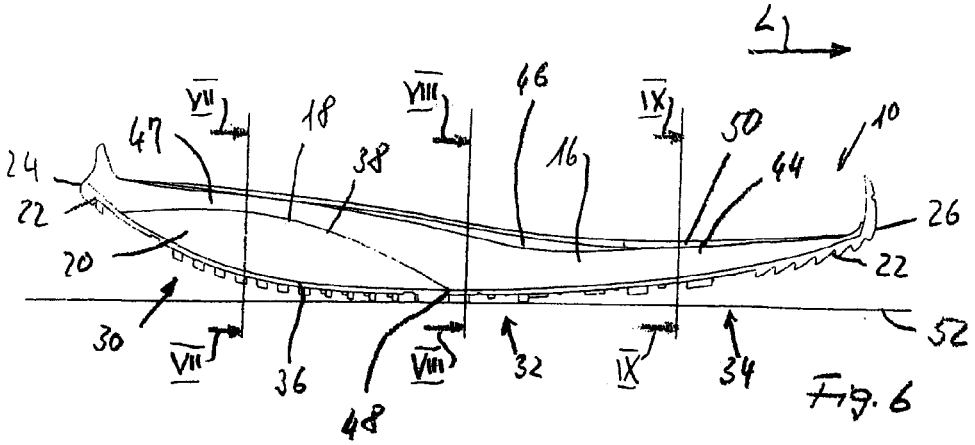
FIG. 6 shows the shoe bottom of FIGS. 1 to 5 in a longitudinal section extending in the walking direction.
Figures 7, 8, 9:
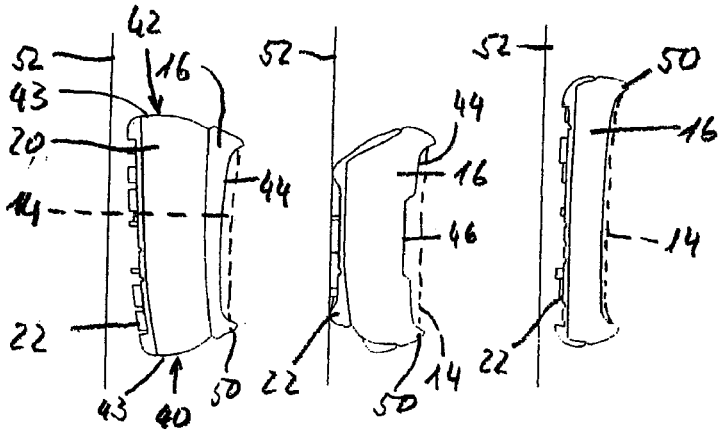
FIG. 7 shows the shoe bottom in a cross section along the line of VII-VII of FIG. 6.
FIG. 8 shows the shoe bottom in cross section along the line VIII-VIII of FIG. 6.
FIG. 9 shows the shoe bottom in cross section along the line IX-IX of FIG. 6.

As FIGS. 4 and 7 illustrate, the soft heel part 20 is made wider—transversely to the walking direction L—on its underside 36 adjoining the outsole 22 than on its upper side 38, facing the midsole 16. Both on the outer side 40 and on the inner side 42 of the shoe bottom 10, the side walls 43 of the soft heel part 20 are convexly formed. This embodiment of the soft heel part 20 provides a somewhat better transverse stability than in the case of an embodiment with an underside 36 and upper side 38 of the soft heel part 20 that are of the same width, in particular if the outsole 22 is formed in a waisted manner.

Furthermore, in a preferred way, as illustrated in particular by FIG. 7, the thickness of the soft heel part 20 on the outer side 40 is less than on the inner side 42, so that in the heel region 30 the outsole 22 has a correspondingly diagonal distortion.

The soft heel part 20 completely fills the recess 18 between the midsole 16 and the outsole 22 and extends from approximately the rear end 24 of the shoe bottom 10, in the walking direction L, over the heel region 30 to approximately the middle of the shoe bottom 10. In its mid-region, the soft heel part 20 has a thickness of approximately 20 mm.

The midsole 16 is formed as a preferably homogeneous body without a reinforcing element 12 and is produced, for example, from a polyurethane elastomer foam or an ethylene vinyl acetate (EVA). Its upper surface 44 has a form similar to a foot bed, but is provided with a depression 46 extending in the walking direction L. This depression 46 has the greatest depth in the midfoot region 32 and extends, with a progressively smaller, diminishing depth, approximately ⅔ into the heel region 30 and extends with a rapidly decreasing depth into the rear end region of the ball and toe region 34.

The smallest thickness of the midsole 16, measured between the soft heel part 20 and the upper surface 44, is very small and is, for example, about 1 mm. The midsole 16 itself is consequently formed very flexibly in its portion 47 lying above the recess 18, with very low intrinsic stability.

With the end of the recess 18 lying at the front in the walking direction L, the midsole 16 forms a tilting edge 48, extending transversely, preferably at least approximately at right angles, to the walking direction L. In this region, the midsole 16 has the greatest thickness of approximately 29 mm and is significantly more rigid there than in the mid-region of the recess 18; in this respect, compare FIGS. 7 and 8, which also show a cross section of the depression 46.

The midsole 16 is made harder than the soft heel part 20, which is consequently highly deformed during stepping and standing and absorbs and dampens shocks. During rolling, the tilting over the tilting edge 48 that is familiar for walking devices of this type is then obtained. The (Shore A) hardness of the midsole 16 is preferably approximately 38-44, but it may also be made somewhat softer or harder. It preferably has approximately twice the Shore A hardness of the soft heel part 20. The modulus of elasticity of the midsole is, for example, between approximately 0.7 and approximately 1.2 N/mm$^2$, preferably between approximately 0.85 and 1.05 N/mm$^2$, measured with a punch of 20 mm in diameter and a loading of 100 N.

The ratio of the modulus of elasticity of the soft heel part 20 to that of the midsole 16 is 1:1.4 to 1:3, preferably 1:1.75 to 1:2.4. The modulus of elasticity of the midsole 16 is consequently approximately twice that of the soft heel part 20.

For the sake of completeness, it should be mentioned that the midsole 16 has a peripheral, upwardly directed collar 50, which serves for joining to the upper 14.

As illustrated in particular by FIGS. 7 to 9, the width of the region of the outsole 22 interacting with the bottom 52, and consequently also of the underlying part of the midsole 16, adjoining said region, in the end region of the recess 18 lying at the front in the walking direction L, and approximately in the middle of the shoe bottom 10, is much smaller than in approximately the middle of the heel region 30 (FIG. 7) and the ball and toe region 34 (FIG. 9). The shoe bottom 10 is formed in a waisted manner.

The reinforcing element 12 shown in FIGS. 10 to 12 is produced, for example, from a mixture of, plastic polyurethane elastomer (TPU) and glass fibers and is made rigid in the midfoot region 32 and in the heel region 30 in such a way that it cannot bend, or only a little, under loading during standing and walking. For this purpose, it has in the midfoot region 32 and heel region 30 a reinforcing rib 54, which is formed equally and oppositely to the depression 46 of the midsole 16, and protrudes in a downward direction; this can also be seen from FIG. 8, in which the reinforcing element 12 is indicated by a dashed line.

The modulus of elasticity of the reinforcing element 12 in the forefoot region is, for example, approximately 8.0 to approximately 13.0 and in the heel region 30 is approximately 12 to 13.5 N/mm$^2$, measured with a punch of 20 mm in diameter and a loading of 1000 N. However, the modulus of elasticity may also be at least approximately constant over the entire reinforcing element 12.

The bending moments of the reinforcing element 12 are in the toe region approximately 70 to 80 Nmm, preferably approximately 75 Nmm, in the ball region approximately 150 to 250 Nmm, preferably approximately 200 to 210 Nmm, and in the ankle region (heel region) approximately 4500 to approximately 6000 Nmm or more, preferably approximately 5100 to 5600 Nmm or more.

The reinforcing element 12 may, for example, have a Shore A hardness between 80 and 120, preferably of approximately 90 to 100.

In the ball and toe region 34, in particular approximately in the front half of this region in the walking direction L, the reinforcing element 12 is preferably more flexibly formed. Here it does not have a reinforcing rib 54 and can be formed more flexibly, for example by the use of a softer, more elastic material component. The two-component or multi-component injection-molding process is suitable for producing such a reinforcing element 12. As indicated in FIG. 10 by the line 56, the part of the reinforcing element 12 with the reinforcing rib 54 is molded from a hard component 58, and then a soft component 60 is molded on; it is also conceivable to reverse this sequence. The hard component 58 and the soft component 60 are affinitive plastics, which bond together extremely stably in injection-molding. Suitable as the hard component 58 and the soft component 60 are, in particular, a mixture of thermoplastic polyurethane elastomer (TPU) and glass fibers and thermoplastic polyurethane elastomer (TPU), respectively. Preferably, a glass fibre reinforced TPU (hard) is used as the hard component 58 and a TPU (soft) is used as the soft component 60.

The reinforcing element 12 extends over the entire upper surface 44 of the midsole 16 up to the peripheral collar 50, only a narrow, peripheral gap remaining between said collar 50 and the reinforcing element 12 for the material of the upper 14, compare FIG. 13. In a preferred way, the reinforcing element 12 has on its underside 61 a border recess 62 extending along its border. This serves for receiving and fastening the material of the outer upper 64 and the lining upper 66.

In a known manner, the upper 14 is produced and then its border 68—also known as a lasting allowance—is firmly joined to the reinforcing element 12 by adhesive bonding in the border recess 62. Subsequently, the structural unit comprising the upper 14 and the reinforcing element 12 is placed within the collar 50 onto the upper surface 44 of the midsole 16 and adhesively bonded with the latter over its full surface area, including the collar 50.

The reinforcing element 12 preferably forms the foot bed; however, an insert sole, for example an insole, may also be loosely laid or fastened on it. It may, for example, have a flexible foam covering of approximately 5 mm in thickness, the modulus of elasticity of which is, for example, 0.3 to 0.7, preferably approximately 0.4 to approximately 0.6 N/mm$^2$, measured with a pressure punch of 20 mm in diameter and a loading of 100 N. Preferably, the insert sole is shaped in such a way that it is adapted to the form of the foot. The reinforcing element 12 lends the walking device the stability, in particular in the midfoot region 32 and heel region 30, in order for the walking device itself to have the intentionally soft and destabilizing properties as a result of the soft heel part 20.

Walking tests with a walking device according to the invention under with a loading of 70 kg have shown that the shoe bottom 10 deforms in the heel region 30 by 6 to 7 mm and in the ball region scarcely at all. The soft heel region 20 is compressed by this amount and bears this deformation almost in its entirety.

The soft heel part 20 may be made of the same material as the midsole 16 or a material with similar properties, the soft-elastic properties being achievable by hollow spaces, or recesses. The soft heel part 20 is highly deformable under loading caused by standing and walking; shocks are thereby dampened and, both during walking and during standing, the musculature of the skeleton in particular is worked and trained as a result of the instability of the heel region 30.

Instead of a single reinforcing rib 54, the reinforcing element 12 may have a number of reinforcing ribs, which extend at least approximately parallel in the walking direction L; it is also conceivable that a number of crossing ribs are provided.

For the sake of completeness, it should be mentioned that it is conceivable to join the upper 14 only to the reinforcing element 12 and only to fasten the latter directly to the shoe bottom 10.

The invention claimed is:

1. A shoe comprising:

a shoe bottom extending in a walking direction from a front end to a rear end over a ball and toe region, a midfoot region, and a heel region, the shoe bottom extending in a direction transverse to the walking direction from an inner side to an outer side, the shoe bottom comprising:

a midsole extending over the heel region, the midfoot region, and the ball and toe region, wherein the midsole defines a recess in the heel region;

an outsole having a continuously rounded convex form in the walking direction while in an unloaded state; and a soft heel part arranged in the recess and extending in the walking direction from the rear end to the midfoot region to completely fill the recess, the soft heel part extending in the transverse direction an entire width of the shoe bottom from a first side wall at the inner side of the shoe bottom to a second side wall at the outer side of the shoe bottom;

a reinforcing element fastened to an upper surface of the midsole, facing away from the outsole, to form an insole, wherein the reinforcing element reinforces the midsole such that the midsole is substantially rigid with respect to loads during standing and walking in its portion located above the soft heel part, wherein the reinforcing element has at least one reinforcing rib in the midfoot region, the at least one reinforcing rib protruding into a depression in the upper surface of the midsole, wherein the at least one reinforcing rib limits bending of the reinforcing element in the midfoot region under the loads during standing and walking; and an upper, arranged on the shoe bottom.

2. The shoe of claim 1, wherein the first and second side walls of the soft heel part are convexly formed.

3. The shoe of claim 1, wherein a thickness of the soft heel part at the first side wall is greater than a thickness of the soft heel part at the second side wall.

4. The shoe of claim 1, wherein the soft heel part has a convex-convex-lenticular cross section, which extends continuously between the first side wall and the second side wall.

5. The shoe of claim 1, wherein a mid-region of the soft heel part, relative to the walking direction, has a thickness of 20 mm.

6. The shoe of claim 1, wherein the soft heel part is wider at an underside, facing the outsole, than at an upper side, facing the midsole.

7. The shoe of claim 1, wherein a thickness of the midsole is greatest at the midfoot region to form a tilting edge extending transversely to the walking direction.

8. The shoe of claim 1, wherein the upper is fastened directly to the reinforcing element and to the midsole.

9. The shoe of claim 1, wherein the reinforcing element substantially covers an entirety of the upper surface of the midsole.

10. The shoe of claim 1, wherein the reinforcing rib protrudes into the heel region and limits bending of the reinforcing element in the heel region under the loads during standing and walking.

11. The shoe of claim 10, wherein the reinforcing element is at least almost rigid with respect to the loads during standing and walking in the heel region and midfoot region.

12. The shoe of claim 11, wherein the reinforcing element does not include the at least one reinforcing rib in at least a portion of the ball and toe region such that the reinforcing element is flexibly formed, at least in the portion of the ball and toe region.

13. The shoe of claim 10, wherein the depression in the upper surface of the midsole has a depth that is greatest in the midfoot region, wherein the depression extends with diminishing depth into the heel region.

14. The shoe of claim 1, wherein the reinforcing element is produced from at least one hard and one soft plastic component.

15. The shoe of claim 1, wherein the outsole has a radius of curvature of approximately 150 mm to 200 mm in the heel region, a radius of curvature of approximately 250 mm to 350 mm in the midfoot region, and a radius of curvature of approximately 350 mm to 480 mm in the ball and toe region.

16. The shoe of claim 1, wherein the reinforcing element and the insole have a bending moment of approximately 4500 to 6000 Nmm in the heel region.

17. The shoe of claim 1, wherein the reinforcing element is at least one of more rigid and harder than the midsole.

18. The shoe of claim 1, wherein the reinforcing element has a modulus of elasticity and a hardness, at least one of the modulus of elasticity and the hardness being greater than a modulus of elasticity and a hardness of the midsole.

19. A shoe comprising:

a shoe bottom extending in a walking direction from a front end to a rear end over a ball and toe region, a midfoot region, and a heel region, the shoe bottom extending in a direction transverse to the walking direction from an inner side to an outer side, the shoe bottom comprising:

a midsole extending over the heel region, the midfoot region, and the ball and toe region, wherein the midsole defines a recess in the heel region;

an outsole having a continuously rounded convex form in the walking direction while in an unloaded state; and a soft heel part arranged in the recess and extending in the walking direction from the rear end to the midfoot region to completely fill the recess;

a reinforcing element fastened to an upper surface of the midsole, facing away from the outsole, to form an insole, wherein the reinforcing element reinforces the midsole such that the midsole is substantially rigid with respect to loads during standing and walking in its portion located above the soft heel part; and an upper, arranged on the shoe bottom;

wherein the soft heel part has a convex-convex-lenticular cross section, which extends continuously between the inner side and the outer side of the shoe bottom;

wherein the reinforcing element has at least one reinforcing rib in the midfoot region, the at least one reinforcing rib protruding into a depression in the upper surface of the midsole, wherein the at least one reinforcing rib limits bending of the reinforcing element in the midfoot region under the loads during standing and walking; and wherein a thickness of the midsole is greatest at the midfoot region to form a tilting edge extending transversely to the walking direction, wherein the midsole is raised relative to the tilting edge at the heel region and the ball and toe region.

20. The shoe of claim 19, wherein the soft heel part includes a first side wall at the inner side of the shoe bottom and a second side wall at the outer side of the shoe bottom, wherein the first and second side walls are convexly formed.

* * * * *